United States Patent [19]

Newnham et al.

[11] Patent Number: 4,999,819

[45] Date of Patent: Mar. 12, 1991

[54] TRANSFORMED STRESS DIRECTION ACOUSTIC TRANSDUCER

[75] Inventors: Robert E. Newnham; Qichang C. Xu, both of State College; Shoko Yoshikawa, Bellefonte, all of Pa.

[73] Assignee: The Pennsylvania Research Corporation, University Park, Pa.

[21] Appl. No.: 510,490

[22] Filed: Apr. 18, 1990

[51] Int. Cl.[5] ..... H04R 17/00

[52] U.S. Cl. ..... 367/157; 367/161; 310/334; 310/337

[58] Field of Search ..... 367/157, 160, 161; 310/334, 337, 368, 369

[56] References Cited

U.S. PATENT DOCUMENTS 3,158,762 11/1964 Horan ..... 367/161

3,346,838 10/1967 Johnson, III et al. ..... 367/157

4,135,108 1/1979 Besson ..... 310/369

*Primary Examiner*—Charles T. Jordan

*Assistant Examiner*—J. Woodrow Eldred

*Attorney, Agent, or Firm*—Thomas J. Monahan

[57] ABSTRACT

This invention describes an acoustic transducer assembly wherein an extremely high figure of merit ($d_h g_h$) is obtained as a result of converting incoming acoustic axial stress into radial extensional stress thereby multiplying its effect. The piezoelectric active element is encased in a metal sandwich enclosing two semilunar air spaces which allow the device to withstand extremely high hydrostatic pressure yet still respond to low level sound waves when acting as a hydrophone. The mechanical prestress induced by the differential coefficients of expansion between the metal case and the piezoelectric ceramic element also serves to prevent depolarization aging.

8 Claims, 1 Drawing Sheet

TRANSFORMED STRESS DIRECTION ACOUSTIC TRANSDUCER

FIELD OF THE INVENTION

This invention relates to acoustic transducers and, more particularly, to an acoustic transducer which, by its structure, reduces some component of a transducer's hydrostatic piezoelectric coefficient while amplifying the coefficient's other components, to thereby substantially increase the figure of merit of the transducer.

BACKGROUND OF THE INVENTION

The prior art is replete with electro-acoustic transducers, particularly usable for underwater acoustic detection and transmission. Desirable properties of such transducers are: a high hydrostatic piezoelectric coefficient ($d_h$) and a high hydrostatic voltage coefficient ($g_h$); a relatively high dielectric constant; a hydrostatic sensitivity in the low frequency range; and no variation of $g_h$ with changing hydrostatic pressures.

The hydrostatic piezoelectric coefficient $d_h$ is given by the equation: $d_h = d_{31} + d_{32} + d_{33}$. $d_{33}$ denotes the uniaxial piezoelectric coefficient for the relationship of polarization in the "3" direction (thickness dimension) to stress in that direction. $d_{31}$ and $d_{32}$ are uniaxial piezoelectric coefficients for orthogonal directions in the transverse plane.

Piezoelectric ceramic materials, such as lead zirconate titanate, are often used in acoustic transducers and, if submerged in a liquid, see constant and equal pressures applied to all sides of the transducer. The piezoelectric coefficient $d_h$, under water, is very small because $d_{33}$ and the $d_{31}$, $d_{32}$ values are opposite in sign and almost cancel one another.

The prior art has recognized that one or more of the uniaxial piezoelectric coefficients must be altered in order to maximize the hydrostatic piezoelectric coefficient. For instance, in U.S. Pat. No. 4,649,312 to Robin, et al., the $d_{31}$ and $d_{32}$ uniaxial piezoelectric coefficients are minimized by forming a grid of fibers which are interwoven and then overmolded with a piezoelectric material. This results in the grid and its encompassing piezoelectric material. This results in the grid and its encompassing piezoelectric forming an integral structure, which when subjected to pressure, enables the piezoelectric effects due to the compressive forces normal to the plane of the structure, to predominate.

Others have attempted to improve a hydrophone's uniaxial piezoelectric coefficient $d_{31}$ by combining piezoelectric polymer material and conductive polymer with a metal sheet as an electrode through the use of piezoelectric material, (U.S. Pat. No. 4,786,837 to Kalnin, et al.).

An object of this invention is to provide an improved piezoelectric ceramic based transducer, wherein the $d_{31}$ and $d_{32}$ piezoelectric coefficients augment the $d_{33}$ coefficient rather than detracting from it. This is accomplished by inserting a cavity in the metal electrode. The cavity transforms the incident pressure wave to an internal radial stress on the ceramic, thereby enhancing the electrical response of the transducer.

A further problem with piezoelectric-based acoustic transducers is the aging effect on the polarized piezoelectric ceramic. As is known, piezoelectric ceramics may be poled by applying a high electric field across the sample at an elevated temperature and subsequently cooling the piezoelectric ceramic to room temperature.

Subsequently, a certain percentage of the aligned dipoles is observed to randomly reorient ("age"), thereby reducing the effectiveness of the ceramic's piezoelectricity.

It is another object of this invention to provide an improved piezoelectric transducer wherein aging is minimized and strength is provided to withstand high hydrostatic pressure.

SUMMARY OF THE INVENTION

An acoustic transducer assembly is described which includes a piezoelectric element having a predetermined coefficient of thermal expansion and contraction. A pair of metal plates are positioned to sandwich the piezoelectric element therebetween. Each metal plate has a cavity formed therein and exhibits a coefficient of thermal expansion and contraction which is larger than the coefficient of expansion and contraction for the piezoelectric element. Bonding agents are interposed between the metal plates and the piezoelectric element and the assembly is then bonded together at an elevated temperature, whereby, upon cooling, the metal plates hold the piezoelectric element in compression.

The shallow cavity provides a stress transforming capability, which transforms and amplifies the incoming axial compressive stress and converts it to a radial extensional stress in the ceramic. Also, it can transform and amplify a small radial vibration velocity to a large axial vibration velocity in the transducer.

The robust construction of the transducer provides great strength for deep submergence application under high hydrostatic pressures. The presence of shallow cavities also enables it to withstand shock waves by allowing the metal electrode to deform in contact with the ceramic.

DETAILED DESCRIPTION OF THE INVENTION

Figure 1:
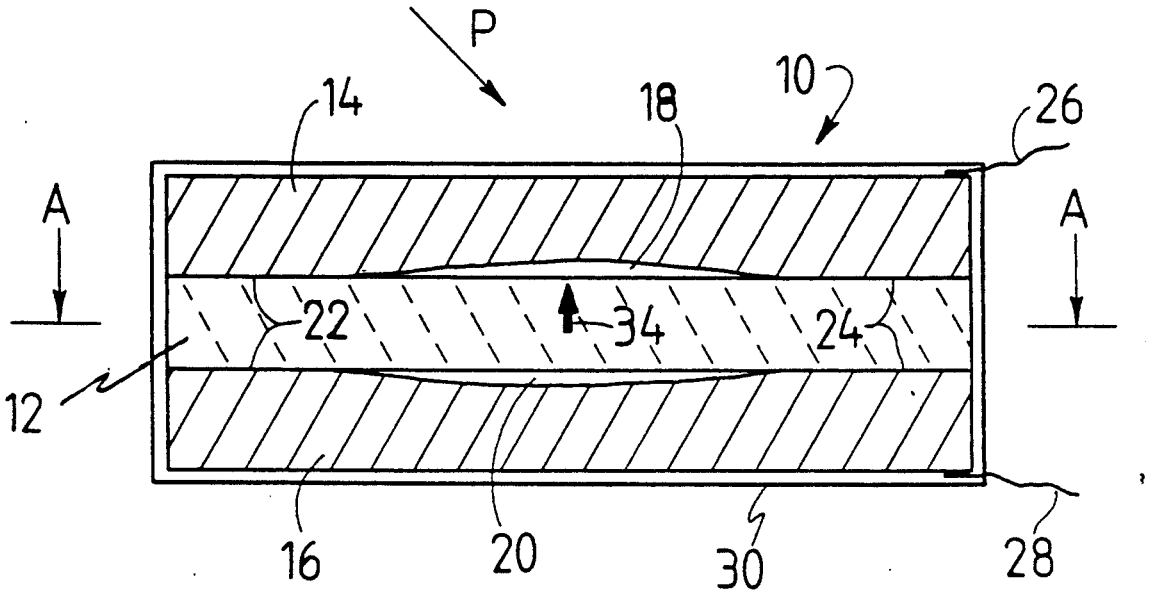

Referring now to FIG. 1, a side sectional view of an acoustic transducer embodying the invention, 10 is shown which embodies the invention. An electroded piezoelectric slab 12 is sandwiched between two metal plates 14 and 16. Metal plates 14 and 16 are each provided with a concave cavity 18 and 20. Each of metal plates 14 and 16 is thus provided with rim areas 22 and 24 which are securely bonded to piezoelectric slab 12. A pair of electrical contacts 26 and 28 make contact with metal plates 14 and 16, respectively, and the entire transducer is enclosed in a waterproof encapsulating polymer 30.

As will be understood from the description below, the acoustic transducer 10 is capable of operating at high hydrostatic pressures. The transducer also has a high sensitivity to weak hydrostatic pressure waves and a large capacitance for easy signal processing. The structure converts a sizable portion of incident hydrostatic stresses on metal plates 14 and 16 to large stresses in the major plane of piezoelectric slab 12. In addition, by appropriately choosing the materials of metal plates 14 and 16 and the bonding materials at rim areas 22 and 24, after processing, piezoelectric slab 12 is held in substantial compression. This thereby reduces the aging effects therein. The relatively thick metal plates 14 and 16 allow the transducer to withstand high external stresses and shockwaves. Furthermore, the transducer is symmetric, top and bottom, thus eliminating bending stresses which otherwise might fracture the piezoelectric ceramic.

Figure 2:
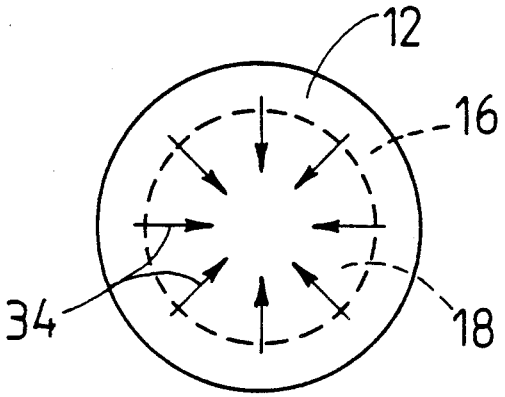

Each of metal plates 14 and 16 is preferably comprised of brass and has a thickness which approximates that of piezoelectric slab 12. As shown in FIG. 2, a plan sectional view taken along line A—A in FIG. 1 of a circular embodiment of the invention, a preferred planar configuration for transducer 10 is circular. The diameter of cavity 18 (and cavity 20) is chosen in accordance with the potential frequency response desired from transducer 10.

A major function of cavities 18 and 20 is to transform stress with "3" direction to the "1" and "2" direction in piezoelectric slab 12. For instance, if a pressure wave P is incident upon metal plate 14, plate 14 is caused to deform toward piezoelectric ceramic 12. As significantly, when plate 14 is bent toward the surface of piezoelectric ceramic 12, it induces stresses in bonded rim areas 22 and 24, which stresses act in the 1 and 2 directions (major plane) outwardly in piezoelectric slab 12. Due to the structure of metal plates 14 and 16, this action resembles a lever arm effect at bonded rim areas 22 and 24, and enhances the induced stresses in piezoelectric slab 12. Assuming that acoustic transducer 10 is employed as a hydrophone, the pressure wave P will, in essence, envelope the transducer and cause both metal plates 14 and 16 to induce radial stresses in piezoelectric slab 12. This doubles the effective instantaneous polarization changes which result from the application of those stresses to the slab.

As described below, during processing, metal plates 14 and 16 are bonded to piezoelectric slab 12 at an elevated temperature. The coefficients of thermal expansion and contraction of metal plates 14 and 16 are chosen to be larger than that of piezoelectric slab 12, so that when the transducer cools after bonding, piezoelectric slab 12 is held in compression by metal plates 14 and 16. Those compressive forces are shown in FIG. 2 by arrows 32.

Compressive forces 32 not only aid piezoelectric slab 12 in withstanding high hydrostatic pressures, but also contribute to a reduction in reorientation of poled dipoles within piezoelectric slab 12. After metal plates 14 and 16 have been bonded to piezoelectric slab 12, the piezoelectric slab is polarized by the application of a high dc field (in the direction shown by arrow 34 in FIG. 1) while the structure is held at an elevated temperature. Upon subsequent cooling, compressive forces 32 tend to prevent the dipoles within piezoelectric slab 12 from reorienting away from the vertical alignment created by the applied field.

Figure 3:
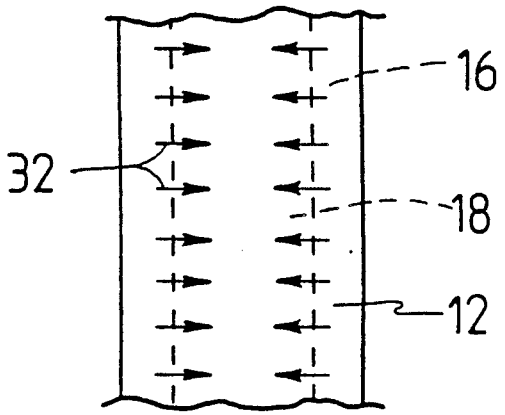

As shown in FIG. 3, a plan sectional view taken along line A—A in FIG. 1 of a rectangular embodiment of the invention, the acoustic transducer 10 can also be configured in rectangular shape. While the compressive stresses within a circular piezoelectric slab cause contributions to be made to both the $d_{31}$ and $d_{32}$ uniaxial piezoelectric coefficients, the induced stresses in the rectangular configuration contribute mainly to the $d_{31}$ uniaxial piezoelectric coefficient. Nevertheless, the structure shown in FIG. 3 is appropriate for certain less stringent applications.

Certain considerations are important when choosing the materials and processing parameters for acoustic transducer 10. Brass is a preferred material for plates 14 and 16. Its coefficient of thermal expansion is approximately 15 ppm/°C. Other conductive metals are equally appropriate, assuming that they can withstand the applied hydrostatic pressures, exhibit an appropriate thermal coefficient and do not corrode at the processing temperatures required to bond plates 14 and 16 to piezoelectric slab 12. Other materials for plates 14 and 16 are nickel, aluminum magnesium alloy, steel with a nickel coating, copper with an appropriate coating to prevent oxidation at elevated processing temperatures.

The composition of piezoelectric slab 12 may be any acceptable piezoelectric ceramics, including $BaTiO_3$, lead titanate system, binary system such as PZT, PMN-PT, PZN-PT, and ternary system such as PCM, SPM.

The piezoelectric ceramic's coefficient of thermal expansion is approximately 5–7 ppm/°C.

The material used to bond the rims of metal plates 14 and 16 to piezoelectric slab 12 should allow no relative movement therebetween to assure optimum transfer of hydrostatic stresses. One appropriate bonding material is silver paste, conductor composition, produced by the DuPont Company, Wilmington, Delaware. That material requires, for bonding to occur, that its temperature be elevated to 600° C. for 10 minutes to provide an appropriately strong bond between piezoelectric slab 12 and metal plates 14 and 16.

Other appropriate bonding materials are Incusil-ABA, and Cusil-ABA, both brazing alloys marketing by Wesgo, GTE Products Corporation, Belmont, California. Other metal based bonding alloys are also acceptable, with the major requirement being that they provide a strong bond between the ceramic piezoelectric material and the material of the metal plates. Any bonding material which allows large relative movement between the plates and the piezoelectric material is to be avoided.

If the transducer is to be used as an element of hydrophone array, the diameter of the transducershould be less than the wavelength of the frequency of the acoustic signal, as the pressure across the device should be constant. A preferred dimension is approximately 1/6th of the wavelength of the acoustic signal. The highest resonant frequency of the transducer used as a hydrophone should be approximately twice the lowest response frequency. The design of the concave areas within cover plates 14 and 16 is, to a large extent, determined by the frequency response characteristics desired for the acoustic transducer. For increased sensitivity, a larger diameter cavity is called for, however, to withstand hydrostatic pressures, the minimum thickness of the metal plates must be maximized. Thus, it can be seen that the specific design requires a number of trade-offs depending upon the particular application.

EXAMPLE

Two brass discs were machined, each having an 11 mm. diameter and thickness of 1.2 mm. The diameter of the concave cavity of each was machined to 7 mm. and the maximum depth of the cavity was between 120 and 250 microns. A circular piezoelectric disc was pressed and sintered. Its composition was PZT-5. DuPont silver paste was applied to the rims of the two brass surfaces, and after the paste was dried, the PZT disc was sandwiched between the two brass discs so that their concave cavities abutted the PZT disc. The brass-sandwiched PZT and silver paste, was heated to 600° C. for 10 minutes, with side supports and some weight thereon to insure proper bonding. The transducer was then allowed to cool to room temperature. The brass-sandwiched PZT assembly was encapsulated with epoxy resin and cured at 90° C. for eight (8) hours. The PZT was then poled by immersing the transducer in a silicone oil bath, heated to 120° C. An electric field of 2.2 kilovolts per mm. was applied for 15 minutes. The piezoelectric characteristics of the structure were tested after 24 hours and a figure of merit ($d_{hgh}$) of $50{,}000 \times 10^{-15}$ $m^2/Nt$ was measured.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

Thus, while we have illustrated and described the preferred embodiment of our invention, it is to be understood that this invention is capable of variation and modification, and we, therefore, do not wish or intend to be limited to the precise terms set forth, but desire and intend to avail ourselves of such changes and alterations which may be made for adapting the invention of the present invention to various usages and conditions. Accordingly, such changes and alterations are properly intended to be within the full range of equivalents and, therefore, within the purview of the following claims. The terms and expressions which have been employed in the foregoing specification are used therein as terms of description and not of limitation, and thus there is no intention in the use of such terms and expressions of excluding equivalents of features shown and described or portions thereof, it being recognized that the scope of the invention is defined and limited only by the claims which follow.

Having thus described our invention and the manner and process of making and using it in such full, clear, concise, and exact terms so as to enable any person skilled in the art to which it pertains, or to with which it is most nearly connected, to make and use the same.

What is claimed is:

1. An acoustic transducer assembly comprising: a piezoelectric element having a stress transforming capability which transforms and amplifies an incoming axial compressive stress and converts it to a radial extensional stress in piezoelectric ceramic; at least a pair of metal means positioned to sandwich said piezoelectric element therebetween, each said metal means having a cavity formed therein, each having a coefficient of thermal expansion and contraction which is larger than said coefficient of thermal expansion and contraction for said piezoelectric ceramic; and bonding means interposed between said metal means and said piezoelectric ceramic for bonding said metal means and said piezoelectric ceramic at an elevated temperature, whereby, upon cooling, said metal means holds said piezoelectric ceramic in compression.

2. The transducer assembly as recited in claim No. 1 wherein said piezoelectric element is planar in shape.

3. The transducer assembly as recited in claim No. 2 wherein said piezoelectric element is circular in shape.

4. The transducer assembly as recited in claim No. 3 wherein said piezoelectric element is a piezoelectric ceramic selected from the group consisting of barium titanates, lead titanates, lead zirconate titanates, lead magnesium niobates and lead zinc niobates.

5. The transducer assembly as recited in claim No. 4 wherein said bonding means is a metal-based paste which, after heating and subsequent cooling, does not allow large relative movement between bonded areas of said metal means and said piezoelectric element.

6. The transducer assembly as recited in claim No. 5 wherein each said metal means is a solid circular plate having a rim circling a concave portion formed in a first surface thereof, said first surface oriented toward said piezoelectric elements so that said rim is bonded to said piezoelectric means by said bonding means.

7. The transducer is recited in claim No. 6 wherein each said metal means is comprised of conductive metals selected from the group consisting of nickel, aluminum magnesium alloy, steel with a nickel coating, and copper alloys with a coating to prevent oxidation at elevated processing temperatures.

8. The transducer assembly as recited in claim No. 2 wherein said piezoelectric element is rectangular in shape.

* * * * *

UNITED STATES PATENT AND TRADEMARK OFFICE

CERTIFICATE OF CORRECTION

PATENT NO. : 4,999,819

DATED : March 12, 1991

INVENTOR(S) : Robert E. Newnham, et al

It is certified that error appears in the above-identified patent and that said Letters Patent is hereby corrected as shown below:

Column 1, line 6: insert --This invention was made with Government support under Grant N00014-89-J-1689 awarded by the Department of the Navy. The Government has certain rights in this invention.--

Signed and Sealed this

Tenth Day of August, 1993

*Attest:*

Michael K. Kirk

MICHAEL K. KIRK

*Attesting Officer*

*Acting Commissioner of Patents and Trademarks*